US009383723B2

(12) United States Patent
Robin

(10) Patent No.: US 9,383,723 B2
(45) Date of Patent: Jul. 5, 2016

(54) GRAND DATE DISPLAY DEVICE FOR A TIMEPIECE

(71) Applicant: Blancpain S.A., Le Brassus (CH)

(72) Inventor: Martin Robin, Lausanne (CH)

(73) Assignee: Blancpain S.A., Le Brassus (CH)

( * ) Notice: Subject to any disclaimer, the term of this patent is extended or adjusted under 35 U.S.C. 154(b) by 0 days.

(21) Appl. No.: 14/930,998

(22) Filed: Nov. 3, 2015

(65) Prior Publication Data

US 2016/0124386 A1 May 5, 2016

(30) Foreign Application Priority Data

Nov. 5, 2014 (EP) ..... 14191899

(51) Int. Cl.
*G04B 19/247* (2006.01)
*G04B 19/24* (2006.01)

(52) U.S. Cl.
CPC ..... *G04B 19/247* (2013.01); *G04B 19/24* (2013.01)

(58) Field of Classification Search
CPC ..... G04B 19/24; G04B 19/243; G04B 19/24306; G04B 19/247
USPC ..... 368/37
See application file for complete search history.

(56) References Cited

U.S. PATENT DOCUMENTS 3,518,825 A * 7/1970 Nissen ..... G04B 19/25373 368/37
3,977,179 A 8/1976 Bachmann
7,366,058 B2 * 4/2008 Marki ..... G04B 11/008 368/220
7,724,611 B2 * 5/2010 Groothuis ..... G04B 19/247 368/223
2003/0193840 A1 * 10/2003 Huter ..... G04C 17/0066 368/37
2005/0169108 A1 * 8/2005 Watanabe ..... G04B 19/25366 368/37

FOREIGN PATENT DOCUMENTS

CH 589 881 7/1977
EP 2 154 584 A1 2/2010

OTHER PUBLICATIONS

European Search Report issued Sep. 14, 2015 in European Application 14191899.5, filed on Nov. 5, 2014 (with English translation).

* cited by examiner

*Primary Examiner* — Sean Kayes
(74) *Attorney, Agent, or Firm* — Oblon, McClelland, Maier & Neustadt, L.L.P

(57) ABSTRACT

The invention concerns a grand date display device that can change from displaying the last day of the month to displaying the first day of the following month by means of a single step of the first and of the second upper plates. This feature avoids the requirement for a correction at the end of months of less than 31 days.

5 Claims, 5 Drawing Sheets

GRAND DATE DISPLAY DEVICE FOR A TIMEPIECE

This application claims priority from European patent application No. 14191899.5 filed Nov. 5, 2014, the entire disclosure of which is hereby incorporated herein by reference.

FIELD OF THE INVENTION

The present invention concerns a grand date display device including means for indicating the tens arranged to display selectively four distinct indications, and means for indicating the units arranged to display selectively the numerals from one to 9 and zero, the device being arranged to display the date in a timepiece.

PRIOR ART

There are already known "grand date" display devices for timepieces which meet the above definition. CH Patent No 688671 in particular describes a watch including a "grand date" display device comprising two concentric indicator discs. The smaller of the two discs is arranged to complete one revolution in four steps and it bears the four indications 0, 1, 2 and 3 to represent the tens. The other disc is arranged to complete one revolution in ten steps and it bears the ten indications 0, 1, 2, 3, 4, 5, 6, 7, 8 and 9 to represent the units. Two windows are also provided in the watch dial for reading the date. A known advantage of "grand date" display devices like this one is that it is easier to read the date than in systems equipped with a single date indicator disc.

CH Patent No 688671 also explains that the two indicator discs of the display device are driven by a drive wheel with a double toothing formed by superposing two toothed wheels of the same diameter which are joined to each other. A first toothing of the drive wheel comprises 30 teeth separated by one 31st of a revolution, in addition to a space that replaces the 31st tooth. Each tooth of the first toothing is arranged to advance the units indicator disc through one step. It will therefore be understood that each revolution of the drive wheel advances the units indicator disc through 30 steps (which corresponds to exactly 3 revolutions). The second toothing of the drive wheel comprises four teeth. Each tooth of the second toothing is arranged to advance the tens indicator disc through one step. Each revolution of the drive wheel therefore causes the tens indicator disc to make one complete revolution. It will be understood from the foregoing that the prior art display device that has just been described is a cyclic counter with 31 positions.

There are several known types of date mechanism suitable for actuating a "grand date" display device like the one that has just been described. A first type of date mechanisms is the so-called "simple" date or calendar mechanism. In a simple calendar mechanism, at the end of months of less than 31 days, the "grand date" display device must be advanced manually to update the date mechanism. There are also so-called "annual" calendar mechanisms, and even so-called "perpetual" calendar mechanisms. In a perpetual calendar mechanism, all the end of month changes are made automatically, regardless of the number of days in the month. In an annual calendar mechanism, all the changes are made automatically, with the exception of the transition between the month of February and the month of March.

With known calendar mechanisms, regardless of the type, a correction step is necessary at the end of each month of less than 31 days. In the case of a simple calendar mechanism, it is the person wearing the watch who has the task of correcting the date by manually advancing the date through the required number of days. This is a tedious operation which most watch owners would willingly do without.

In the case of perpetual calendar mechanisms, the correction step occurs automatically. To this end, perpetual calendar mechanisms are usually equipped with a "48" cam which comprises notches of different depths for the months of less than 31 days. The mechanism also includes a lever arranged to cooperate with the 48 cam. The degree of inclination of the lever is determined by the depth of the notch in which its beak is engaged, and this degree of inclination in turn determines the number of days to be corrected at the end of each month. This type of mechanism is both complex and delicate.

BRIEF SUMMARY OF THE INVENTION

It is an object of the present invention to simplify the operations required to update a "grand date" display device at the end of a month of less than 31 days. The present invention achieves this object by providing a grand date display device according to the appended claim 1.

It will be understood that the units number of the date of the last day of a month of less than 31 days is always either an 8, or 9, or zero. Further, according to the invention, these three units numbers are displayed using the first lower plate, the first upper plate being then in an angular position such that said at least one first opening associated with the absent or incomplete eighth character is beneath the display area. Further, the units number of the date of the first day of the month is always "1". 1 is the first of the characters borne by the first upper plate. The position of the 1 on the upper plate thus immediately follows the position of the absent or incomplete eighth character. It will thus be understood that, according to the invention, by means of a single step of the first upper plate, the "1" can be immediately substituted for the units number of the last day of a month of less than 31 days. It will also be understood that, in the case where the last day of the month is 31, the change to the first day of the following month can occur with no change to the units number.

An advantageous variant of the invention conforms to claim 2 appended hereto. According to this variant, the tens numbers 2 and 3 are always displayed by means of a second lower plate and of said at least one second opening associated with the absent or incomplete third character of the second upper plate. The angular position of the second upper plate when the last day of the month is displayed is therefore always that in which the absent or incomplete third character is in the display area. Further, the tens number of the date of the first day of the month is "0", or alternatively an empty space. The 0 is the first of the characters borne by the second upper plate. The position of the 0 on the upper plate therefore immediately follows the position of the third absent or incomplete character. It will therefore be understood that, according to this variant, by means of a single step of the second upper plate, the date "0" can be immediately substituted for the tens number of the last day of the month, this single step of the second upper plate being, as seen above, associated with the single forward step of the first upper plate when the preceding month has less than 31 days.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF ONE EMBODIMENT

Figure 1:
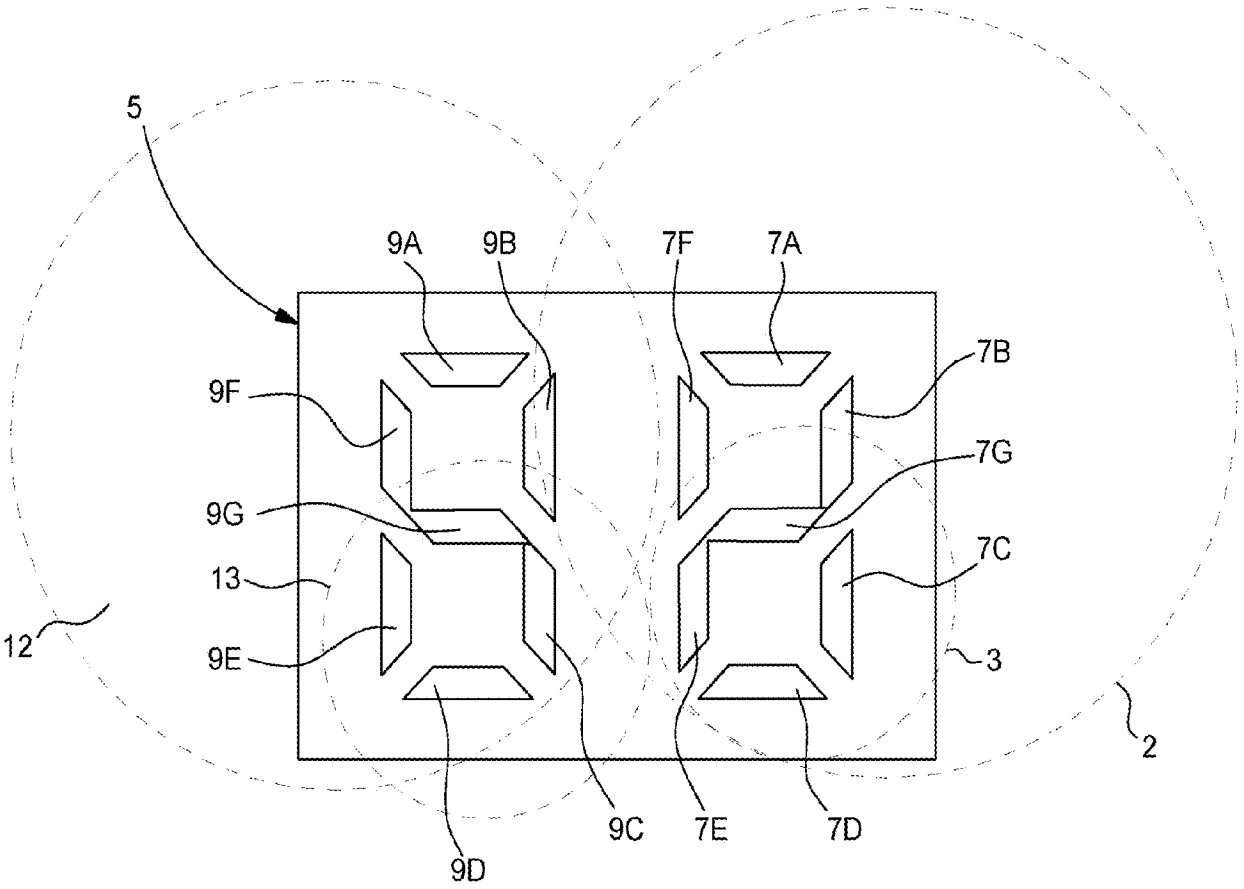
FIG. 1 is a diagram showing the arrangement of the first and second upper and lower plates according to a particular embodiment of the grand date display device of the invention.

FIG. 1 is a top plan view of the cover of a "grand date" display device according to a particular embodiment of the invention. It can be seen in the Figure that, in the illustrated embodiment, openings 7A to 7G (the "third openings") and openings 9A to 9G (the "fourth openings") are provided in a display area 5 of the cover of the display device. It is clear from the Figure that the third openings form part of the units indication means, whereas the fourth openings form part of the tens indication means. Further, the segment form of display used in the illustrated example is a so-called 7-segment display. In manner that is known per se, 7-segment displays can display the numerals from "0" to "9" using seven rectilinear segments (four vertical segments and three horizontal segments) which are distributed over a figure-of-eight line corresponding to the superposition of the numerals from "0" to "9".

According to the invention, the units indication means include a first upper plate 2 and a first lower plate 3. It is noted that the contour of first plates 2 and 3 is shown in dashed lines in FIG. 1. It will be understood that the dashed line indicates that these two elements are concealed by the cover of the display device. It can also be seen that, in the embodiment illustrated, the tens indication means include a second upper plate 12 and a second lower plate 13. These latter two elements are also concealed by the cover of the display device.

Figure 2A:
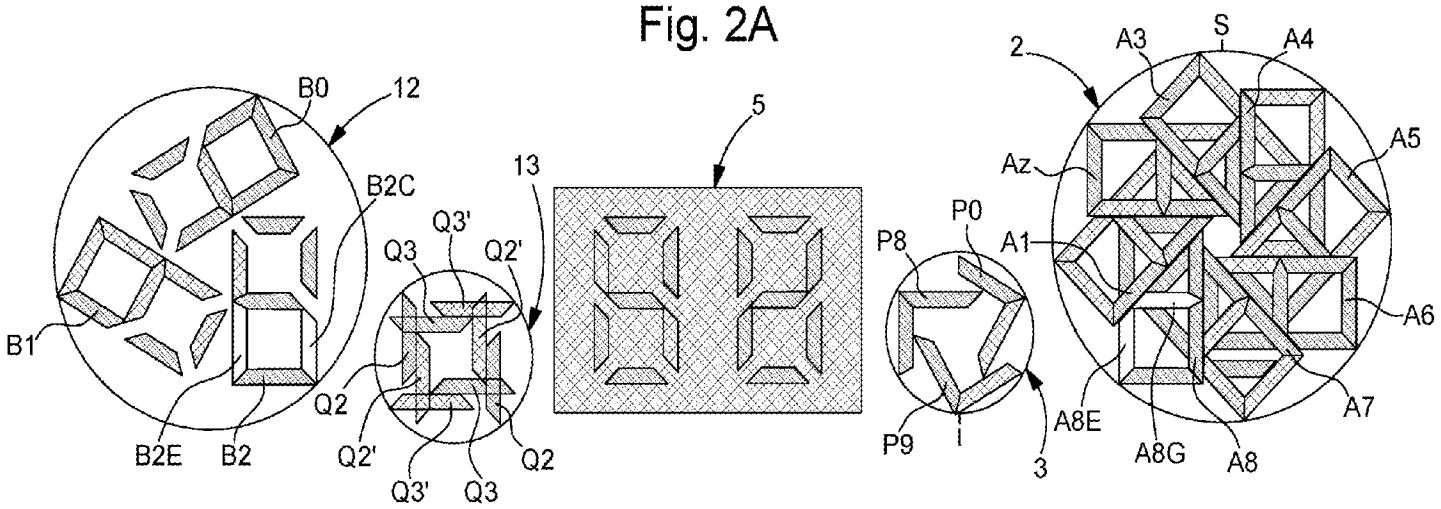
FIG. 2A illustrates the respective angular positions of the first and second upper and lower plates when the 28th day of the month is displayed by the display device of FIG. 1.

FIG. 2A is an exploded representation of elements already shown in the top plan view of FIG. 1. The exploded representation shows the two series of characters respectively borne by first upper plate 2 and second upper plate 12, and the pieces of characters respectively borne by first lower plate 3 and second lower plate 13. The respective angular positions of the first and second upper and lower plates as shown in FIG. 2A correspond to the display of the date "28" by the "grand date" display device.

According to the invention, first upper plate 2 bears a series of eight characters regularly distributed over a wide circular track. Seven of these characters (respectively referenced A1, A2, A3, A4, A5, A6 and A7) are formed by the numerals 1, 2, 3, 4, 5, 6 and 7. The eighth character (referenced A8) is incomplete. It is formed by a numeral 8 with two cutout segments, these two segments being replaced by openings (called first openings and referenced A8E and 8AG) also in the form of segments. It will be noted that the characters encroach on each other, and that two overlapping characters form a 45° angle between them. The characteristic of the present example according to which two intertwined figures form an angle of 45° between them, is particularly advantageous when the display principle used is that of the 7-segment display. Indeed, as was seen above, the 7-segment display uses four vertical segments and three horizontal segments. As confirmed by FIG. 1, there are therefore no oblique segments. In these conditions, since two overlapping characters form between them an angle of 45°, the third openings in the cover can only reveal one character at a time in the display area.

According to the invention, the first lower plate 3 bears a pattern formed of pieces of characters. In the illustrated example, these pieces of characters (referenced P8, P9 and P0) are three in number, and form between them angles of 120°. These pieces of characters are arranged to form respectively the numerals 8, 9 and 0 in association with the incomplete eighth character, when they appear beneath at least one of first openings A8E and A8G. It will be understood that, in FIG. 2A, it is piece P8 that is intended to be immediately beneath first openings A8D and A8G, so that it completes the eighth character to form an 8. In other words, the numeral displayed by the units indication means is an 8.

The operation of the units indication means will now be explained. In order to refer more easily to a particular angular position of the first upper plate or the first lower plate, these 2 plates are each provided, in FIGS. 2 to 5, with an index (respectively referenced "S" and "I"). In FIG. 2A, it can be seen that the index "I" is positioned at 6:00 hours and the index "S" is positioned at 12:00 hours. It will therefore be understood that, when index S is at midday, and also index I of the first lower plate is oriented in the direction of 6:00 hours, the configuration of the first plates corresponds to the display of the numeral 8 by the units indication means.

The sequence of one complete units cycle will now be described. The complete units cycle is formed of the sequence of numerals 1, 2, 3, 4, 5, 6, 7, displayed by first upper plate 2, followed by the sequence of numerals 8, 9, 0 displayed by first lower plate 3 in association with the incomplete eighth character A8 of the upper plate. The cycle starts with index S at 10:30 hours (cf. FIG. 2B). In this angular position the numeral 1 appears through the third openings 7B and 7C of the cover. It will also be noted that the character A1 includes additional segments which have the same colour as display area 5 of the cover and whose presence has the effect of concealing the five third openings which are not involved in indicating the numeral 1.

Although the first upper plate is not illustrated in these angular positions, it will be understood that when the first upper plate then makes a 45° step in the anticlockwise direction, index S is positioned at 9:00 hours and the numeral 2 appears through the third openings 7A, 7B, 7D, 7E and 7G. One step further places index S at 7:30 hours and positions the numeral 3 immediately beneath the third openings. Index S is then placed at 6:00 hours to display the numeral 4, then at 4:30 hours for the numeral 5, at 3:00 hours for the numeral 6 and at 1:30 hours for the numeral 7. It will be noted that throughout the part of the cycle that has just been described, the character pieces P8, P9 and P0 borne by the first lower plate 3 are concealed by upper plate 2. Thus, the lower plate is not involved in the display, and its angular position does not play any part.

Next, when the first upper plate makes another step in the anticlockwise direction, index S is placed at midday (as shown in FIG. 2A) and the incomplete eighth character appears through the third openings. Further, the first openings A8E and A8G are immobilised directly beneath third openings 7E and 7G. One of the three character pieces P8, P9 and P0 can appear through at least one of the first openings (in FIG. 2A as seen above, it is piece P8 that appears). In other words, to indicate the numeral 8, index I must be positioned at 6:00 hours.

Figure 3A:
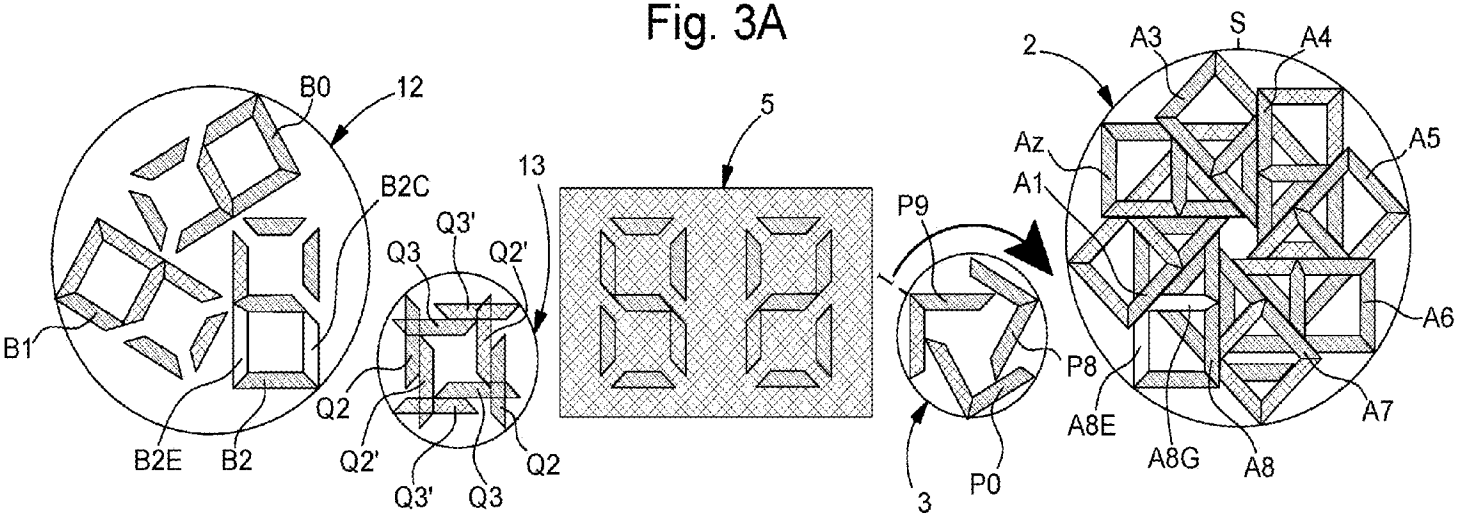
FIG. 3A illustrates the respective angular positions of the first and second upper and lower plates when the 29th day of the month is displayed by the display device of the preceding Figures.

Next, when the first lower wheel 3 makes a 120° step in the clockwise direction, index I is placed at 10:00 hours and character piece P9 replaces piece P8 (cf. FIG. 3A). Character piece P9 includes a segment whose colour contrasts with the colour of the cover and an additional segment whose colour is the same as that of the cover. The first of these segments appears through the first opening A8G and the third opening 7G so as to complete the eighth character to form a 9. The second segment of character piece P9 is immediately below the superposed openings A8E and 7E. Since its colour matches that of the cover, its presence has the effect of concealing the third opening 7E.

Figure 4A:
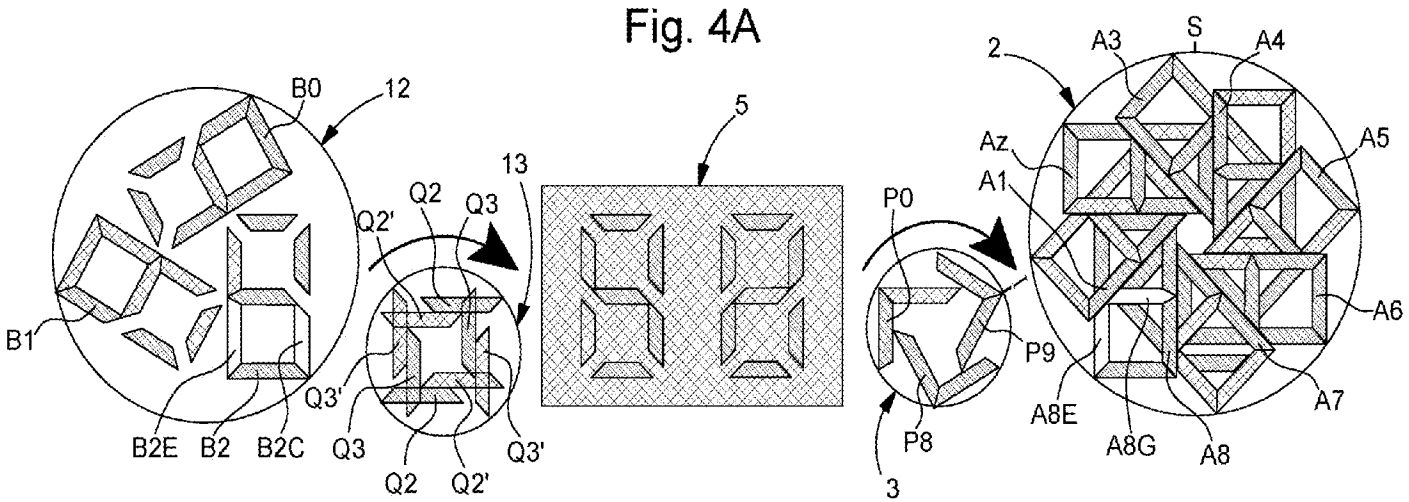
FIG. 4A illustrates the respective angular positions of the first and second upper and lower plates when the 30th day of the month is displayed by the display device of the preceding Figures.

Next, when the first lower plate makes yet another step, index I is placed at 2:00 hours and character piece P0 replaces piece P9 (cf. FIG. 4A). A segment whose colour contrasts with that of the cover appears through first opening A8E and third opening 7E so as to complete the eighth character to form a 0. It is important to note that the first upper plate does not change orientation when the units display changes from 8 to 9 and then from 9 to 0.

Referring again to FIG. 2A it is observed that in the illustrated example, the tens indication means are similar to the units indication means. Indeed, according to an advantageous variant of the invention, second upper plate 12 bears a series of three characters regularly distributed every 120° over a wide circular track. Two of these characters (respectively referenced B0 and B1) are formed by the numerals 0 and 1. The third character (referenced B2) is incomplete. It can be seen that its outline corresponds to that of a numeral 8 with two cutout segments, these two segments being replaced by openings ("first openings" referenced B2C and B2E) also in the form of segments.

Still referring to FIG. 2A, it can be seen that second lower plate 13 bears a pattern formed of four horizontal segments and four vertical segments. It is also to be noted that this pattern has a rotational symmetry of order 2. The colour of two of the four vertical segments contrasts with that of display area 5 of the cover. These two segments, which have 180° rotational symmetry, are both referenced Q2. The two other vertical segments are the same colour as the cover. They are also have 180° rotational symmetry and are referenced Q2'. The colour of two of the four horizontal segments contrasts with that of display area 5 of the cover. These two segments, which have 180° rotational symmetry, are both referenced Q3. The other two horizontal segments are the same colour as the cover. They are also have 180° rotational symmetry and are referenced Q3'.

It is also observed in the Figure that one segment Q2 and one segment Q2' are stopped directly beneath second openings B2C and B2E. It will be understood that segments Q2 and Q2' form pieces of characters which are arranged to form the numeral 2 in association with the incomplete third character B2.

The sequence of one complete tens cycle will now be described. The complete tens cycle is formed of the sequence of numerals 0 and 1 displayed by the second upper plate 12 followed by the sequence of numerals 2 and 3 displayed by second lower plate 13 in association with the incomplete third character B2 of the upper plate. The cycle starts with the second upper plate 12 oriented such that character B0 (the numeral 0) is at the bottom right. In this angular position, the numeral 0 appears through the fourth openings 9A, 9B, 9C, 9D, 9E and 9F of the cover. It will also be noted that the character B0 includes an additional segment which has the same colour as display area 5 of the cover and whose presence has the effect of concealing the fourth opening 9G which is not involved in the display of the numeral 0.

When the second upper plate then makes a 120° step in the clockwise direction, the character B1 takes the place of character B0 and the numeral 1 appears through fourth openings 9B and 9C. It will be noted that during this first part of the cycle, the character pieces Q2, Q2', Q3 and Q3' borne by second lower plate 13 are concealed by upper plate 12. Thus, the lower plate is not involved in the display, and its angular position does not play any part.

Next, when the second upper plate makes another step in the clockwise direction, character B2 is placed at the bottom left (as shown in FIG. 2A) and the incomplete third character appears through the fourth openings. Further, the second openings B2C and B2E are immobilised directly beneath fourth openings 9C and 9E. One of the segment pairs Q2-Q2' or Q3-Q3' may appear through the second openings (in FIG. 2A as seen above, it is the pair Q2-Q2' that appears). It will be understood that, to indicate the numeral 2, second lower plate 13 must be oriented such that segments Q2 and Q2' are placed directly beneath first openings B2C and B2E.

Next, when second lower plate 13 makes a 90° step, segments Q2 and Q2' are oriented horizontally and segments Q3 and Q3' become vertical. A pair of segments Q3-Q3' replaces the segment pair Q2-Q2' beneath openings B2C and B2E (cf. FIG. 4A). Segment Q3 appears through second opening B2C and segment Q3' is visible through opening B2E. It will be understood that segment Q3 completes the incomplete third character B2 so as to form a 3. Segment Q3' is immediately beneath the superposed openings B2E and 9E. Since its colour matches that of the cover, its presence has the effect of concealing the fourth opening 9E. It is important to note that the second upper plate does not change orientation when the tens display changes from 2 to 3.

It was stated above that it is an object of the present invention to simplify the operations required to update a "grand date" display device at the end of a month of less than 31 days. As can be verified by comparing FIG. 2A to FIG. 2B, FIG. 3A to FIG. 3B, FIG. 4A to FIG. 4B, and finally FIG. 5A to FIG. 5B, the change to the first day of the following month is achieved by a single step of the first and second upper plates.

Figure 2B:
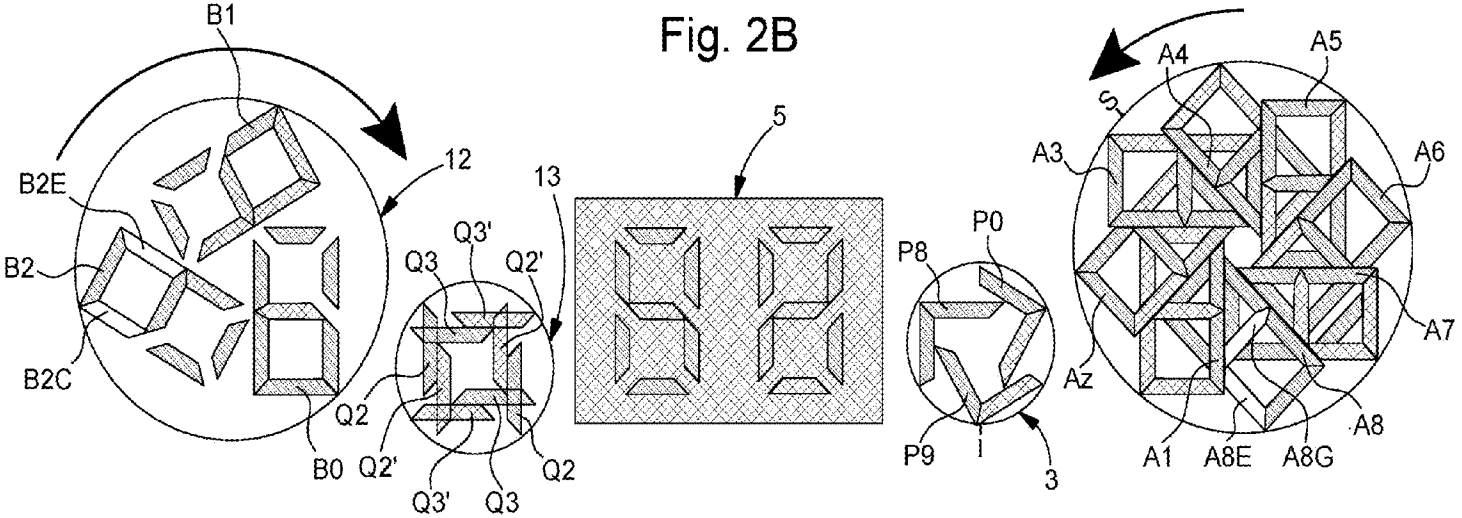
FIG. 2B illustrates how two rotations of one step respectively of the first and the second upper plate allow the display device of FIGS. 1 and 2A to immediately switch the date from the 28th to the 1st day of the month.
Figure 3B:
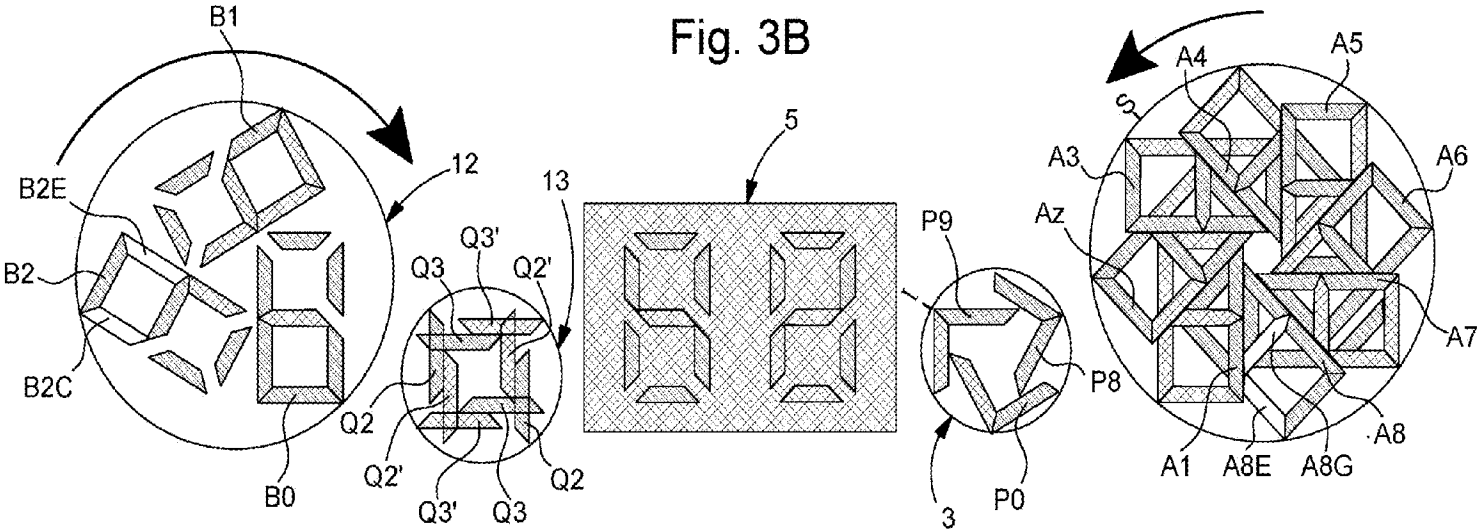
FIG. 3B illustrates how two rotations of one step respectively of the first and the second upper plate allow the display device of the preceding Figures to immediately switch the date from the 29th to the 1st day of the month.
Figure 4B:
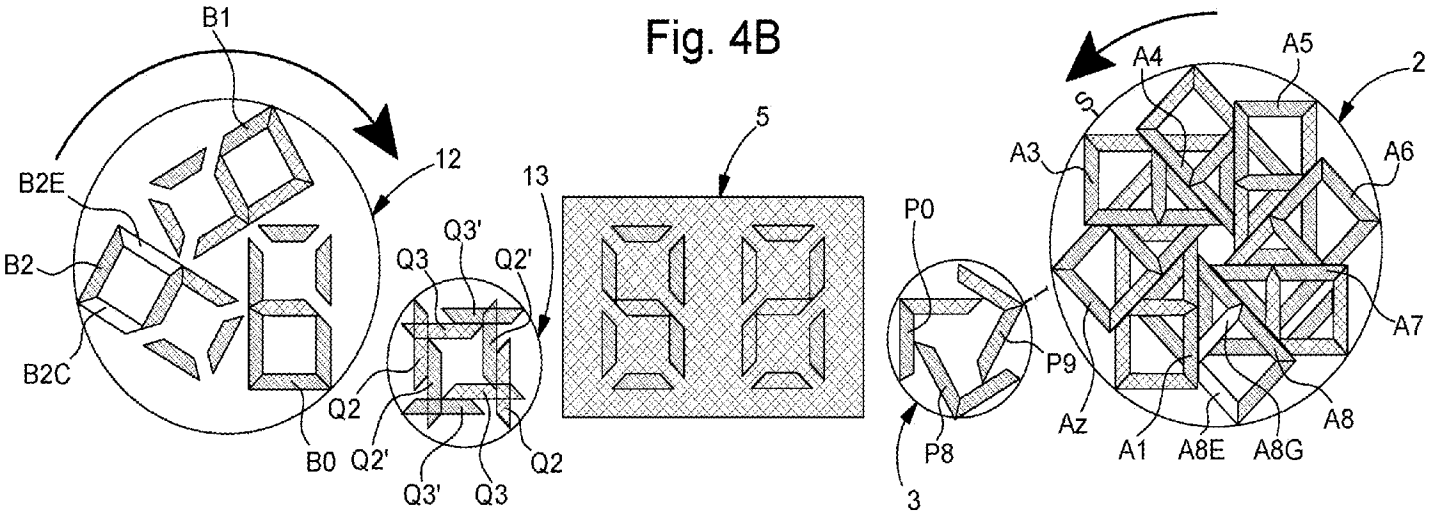
FIG. 4B illustrates how two rotations of one step respectively of the first and the second upper plate allow the display device of the preceding Figures to immediately switch the date from the 30th to the 1st day of the month.
Figure 5A:
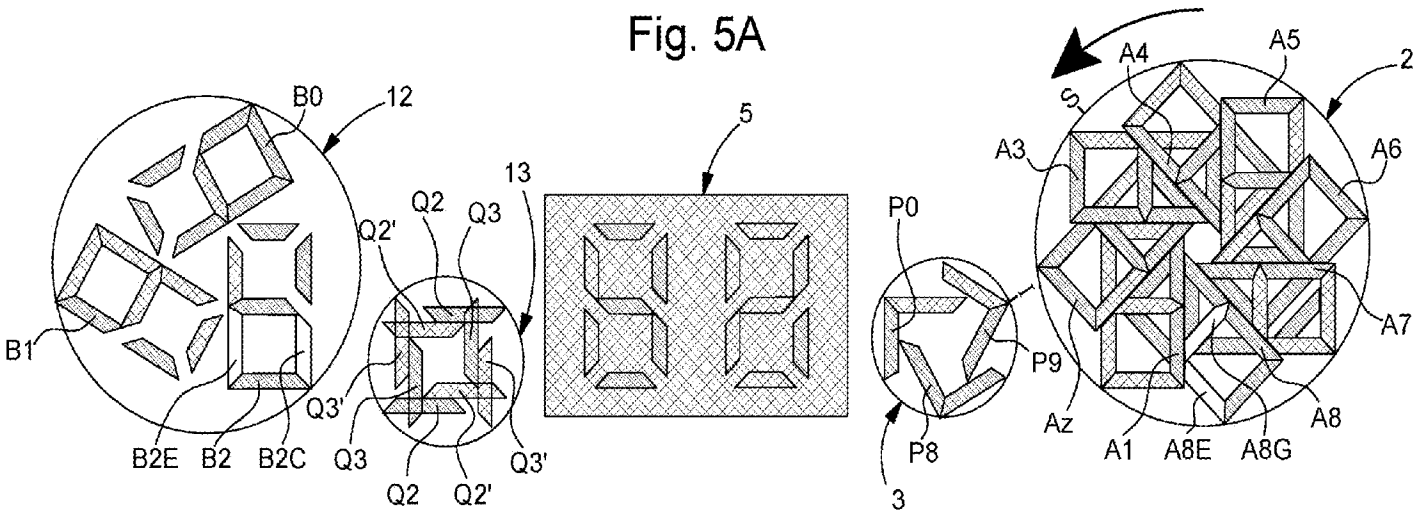
FIG. 5A illustrates the respective angular positions of the first and second upper and lower plates when the 31st day of the month is displayed by the display device of the preceding Figures.
Figure 5B:
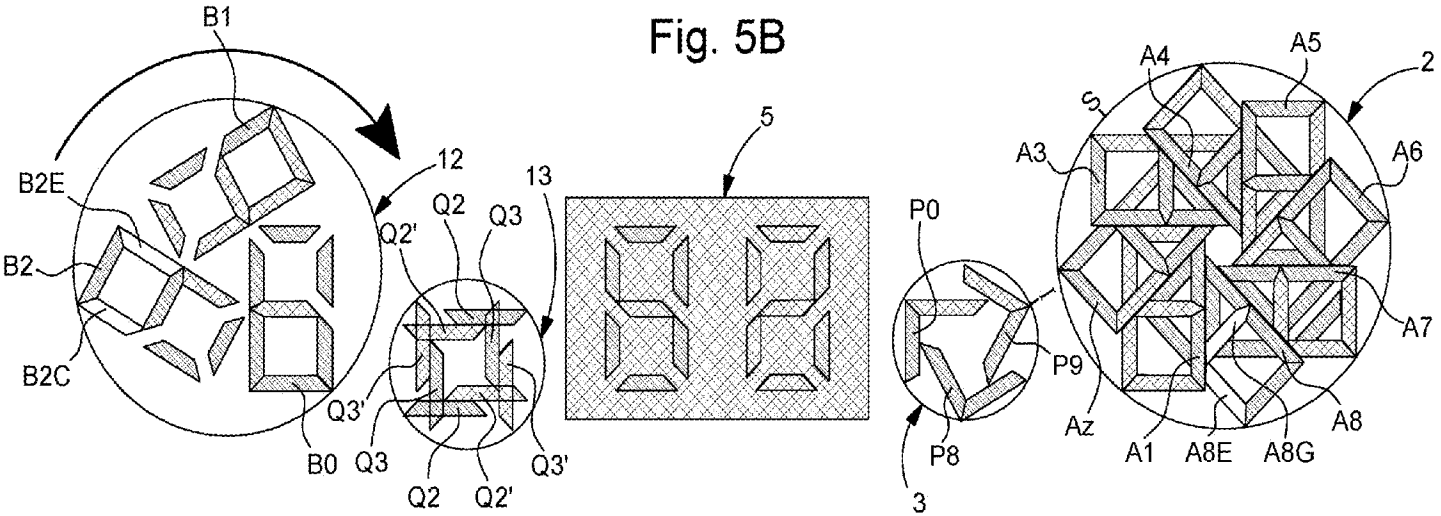
FIG. 5B illustrates how a rotation of one step respectively of the second upper plate allows the display device of the preceding Figures to immediately switch the date from the 31st to the 1st day of the month.

FIGS. 2A and 2B show that the grand date display device can change seamlessly from indicating the 28th day of the month to the 1st by rotating first upper plate 2 through one step in the anticlockwise direction and second upper plate 12 through one step in the clockwise direction. FIGS. 3A and 3B show that the grand date display device can also change seamlessly from indicating the 29th day of the month to the 1st by rotating first upper plate 2 through one step in the anticlockwise direction and second upper plate 12 through one step in the clockwise direction. FIGS. 4A and 4B show that the grand date display device can also change seamlessly from indicating the 30th day of the month to the 1st by rotating first upper plate 2 through one step in the anticlockwise direction and second upper plate 12 through one step in the clockwise direction. FIGS. 5A and 5B show that the grand date display device can change seamlessly from indicating the 31st day of the month to the 1st without rotating first upper plate 2 but simply by advancing second upper plate 12 through one step.

It will also be clear that various alterations and/or improvements evident to those skilled in the art may be made to the embodiment forming the subject of the present description without departing from the scope of the present invention defined by the annexed claims. In particular instead of simply bearing pieces of characters, the first and second lower plates could bear entire numerals. That is to say the numerals "8", "9" and "0" regularly spaced over the first lower plate and the numerals "2" and "3" over the second lower plate. In these conditions, the eighth character of the first upper plate and the third character of the second upper plate could be simply absent and each replaced by an opening that is sufficiently large to reveal a numeral borne by the lower plate.

What is claimed is:

1. A "grand date" display device arranged to be actuated by a date mechanism for a timepiece and including tens indication means arranged to selectively display four distinct indications, and units indication means arranged to selectively display the numerals from 1 to 9 and zero; wherein the units indication means include:

a first upper plate and a first lower plate at least partially superposed in a display area, the first upper plate being arranged to rotate in steps about an axis and bearing, a series formed of the following regularly angularly spaced eight characters: seven characters respectively formed by the numerals 1, 2, 3, 4, 5, 6 and 7 and an incomplete or absent eighth character, the eighth character being associated with at least a first opening revealing the lower plate, the first lower plate being arranged to rotate in steps about an axis and including, regularly angularly spaced characters or pieces of characters arranged to be visible when superposed in the display area, on said at least one first opening of the first upper plate, the first upper plate and the first lower plate being arranged to be driven to display in succession in the display area, first of all a complete first cycle formed of the sequence of numerals displayed by the first upper plate, and then the sequence of numerals 8, 9, 0 each formed by superposing one of said characters or pieces of characters of the first lower plate on said at least one first opening associated with the eighth character of the first upper plate, then a second complete cycle identical to the first complete cycle, and then another third irregular cycle formed of the sequences of numerals 1, 2, 3, 4, 5, 6, 7, completed, according to the length of the current month, first by all or part of said series of numerals 8, 9, 0, then finally, if necessary, the numeral 1 displayed by the first upper plate.

2. The "grand date" display device according to claim 1, wherein the tens indication means include a second upper plate and a second lower plate at least partially superposed in a display area, the second upper plate including the following three regularly angularly spaced characters: a first character formed by the numeral 0, or alternatively by an empty space, a second character formed by the numeral 1, and an absent or incomplete third character associated with at least one second opening revealing said second lower plate, the second lower plate including regularly angularly spaced characters or pieces of characters arranged to be visible when superposed, in the display area, on said at least one second opening of the second lower plate, the second upper plate and the second lower plate being arranged to be driven to display in succession in the display area, first of all the numeral "0", or alternatively an empty space, while the units indication means display the first complete cycle, then the numeral "1" when the units indication means display the second complete cycle, then to display the numeral 2 formed by superposing one of said characters or pieces of characters of the second lower plate on said at least one second opening associated with the third character of the second upper plate when the units display means display the third irregular cycle and finally, if the units display means display the numeral 1 in addition to the irregular cycle, to simultaneously display the numeral 3 formed by superposing one of said characters or pieces of characters of the second lower plate on said at least one second opening associated with third character of the second upper plate.

3. The "grand date" display device according to claim 1, wherein the first lower plate bears a pattern including segments, one of said segments being arranged to stop in the display area immediately beneath one of said first openings so that said segment appears in the display area in combination with the incomplete eighth character, so as to form a numeral to be displayed.

4. The "grand date" display device according to claim 1, including a cover arranged to conceal the first upper plate and the first lower plate, and wherein the characters of the series borne by the first upper plate are intertwined, the cover including a display area having a plurality of third openings distributed over an outline matching the superposed characters of the series of characters borne by the first upper plate, the characters being intended to appear in succession through the third openings during the rotation of the first upper plate, and the third openings being arranged to reveal only one character at a time in the display area.

5. The "grand date" display device according to claim 1, wherein the first lower plate also includes the regularly angularly distributed characters "8", "9" and "0" arranged to be visible through the first opening when said characters are immediately beneath the first opening in the display area.

* * * * *